United States Patent [19]

Hashimoto et al.

[11] 4,109,621

[45] Aug. 29, 1978

[54] INTERNAL COMBUSTION TYPE PILE DRIVER

[75] Inventors: Hiroshi Hashimoto, Akashi; Kyozo Kimura, Kobe, both of Japan

[73] Assignee: Mitsubishi Jukogyo Kabushiki Kaisha, Tokyo, Japan

[21] Appl. No.: 768,617

[22] Filed: Feb. 14, 1977

[51] Int. Cl.[2] ..... F02B 75/02

[52] U.S. Cl. ..... 123/65 SP; 123/65 PE; 123/75 C; 173/135

[58] Field of Search ..... 173/135, 136, 137; 123/65 PE, 65 SP, 65 P, 75 C, 75 E, 65 EM, 73 SP

[56] References Cited

U.S. PATENT DOCUMENTS

| | | | |
|---|---|---|---|
| 1,102,457 | 7/1914 | Twonbly | 123/75 C |
| 1,514,476 | 11/1924 | Still | 123/65 PE |
| 1,952,275 | 3/1934 | Mohr | 123/65 PE |
| 2,093,634 | 9/1937 | Cordes | 173/137 |
| 2,734,488 | 2/1956 | Wampach | 173/137 |
| 2,773,481 | 12/1956 | Blake | 173/135 |
| 3,193,026 | 7/1965 | Kupka | 173/135 |
| 3,679,005 | 7/1972 | Inaba et al. | 173/137 |

FOREIGN PATENT DOCUMENTS

| | | | |
|---|---|---|---|
| 296,522 | 9/1928 | United Kingdom | 123/75 E |

*Primary Examiner*—Charles J. Myhre
*Assistant Examiner*—David D. Reynolds
*Attorney, Agent, or Firm*—Wenderoth, Lind & Ponack

[57] ABSTRACT

An internal combustion type pile drive which has a cylinder, a ram adapted to slide within this cylinder, an anvil fitted into the bottom end of the cylinder and an air intake/exhaust port fixedly provided on said cylinder, is improved so that the height of rise of the ram may be adjustable. The improvement exists in providing a choke opening communicating the interior of the cylinder with the atmosphere for the purpose of adjusting a combustion gas pressure in a cylinder wall between the air intake/exhaust port and a combustion chamber, and either a choke plug or a blind plug is adapted to be fitted in to this choke opening.

4 Claims, 4 Drawing Figures

INTERNAL COMBUSTION TYPE PILE DRIVER

The present invention relates to improvements in an internal combustion type pile driver.

BACKGROUND OF THE INVENTION

An internal combustion type pile driver comprising a cylinder, a ram adapted to slide within said cylinder, an anvil fitted into the bottom end of said cylinder and an air intake/exhaust port fixedly provided on said cylinder, has been heretofore known. However, the known internal combustion type pile drivers has fluctuations in the height of rise of the ram which determines the pile driving power, due to machining errors upon manufacture, and these fluctuations are hard to correct. Even if the height of rise of the ram is proper when the pile driver is new, after it is used for a certain period, wearing of the cylinder, ram and anvil becomes significant, and the pressure of the combustion gas is lowered due to leakage of air and the combustion gas. This results in an insufficient height of rise of the ram which leads a reduction of the pile driving power. In the known internal combustion type pile drivers, it is impossible to recover the original pile driving power for the used pile drivers.

SUMMARY OF THE INVENTION

Therefore, it is one object of the present invention to provide an internal combustion type pile driver in which the height of rise of the ram is adjustable.

Another object of the present invention is to provide an internal combustion type pile driver which can recover its original pile driving power when its pile driving power has been lowered due to wear of the sliding members after a period of use.

According to the present invention, the above-mentioned objects can be achieved by providing in a cylinder wall a variable choke opening for adjusting a gas pressure separately from an air intake/exhaust port so that the height of rise of the ram may be adjusted.

One feature of the present invention is to provide an internal combustion type pile driver comprising a cylinder, a ram adapted to slide within the cylinder, an anvil fitted into the bottom end of the cylinder and an air intake/exhaust port fixedly provided on the cylinder. The invention is characterized by having a choke opening communicating the interior of the cylinder with the atmosphere for the purpose of adjusting a combustion gas pressure. This opening is provided in a cylinder wall between the air intake/exhaust port and a combustion chamber, and either a choke plug or a blind plug is adapted to be fitted in the choke opening.

BRIEF DESCRIPTION OF THE DRAWING

The above-mentioned and other features and objects of the present invention will become more apparent by reference to the following description taken in conjunction with the accompanying drawings, in which.

DETAILED DESCRIPTION OF THE INVENTION

Figure 1:
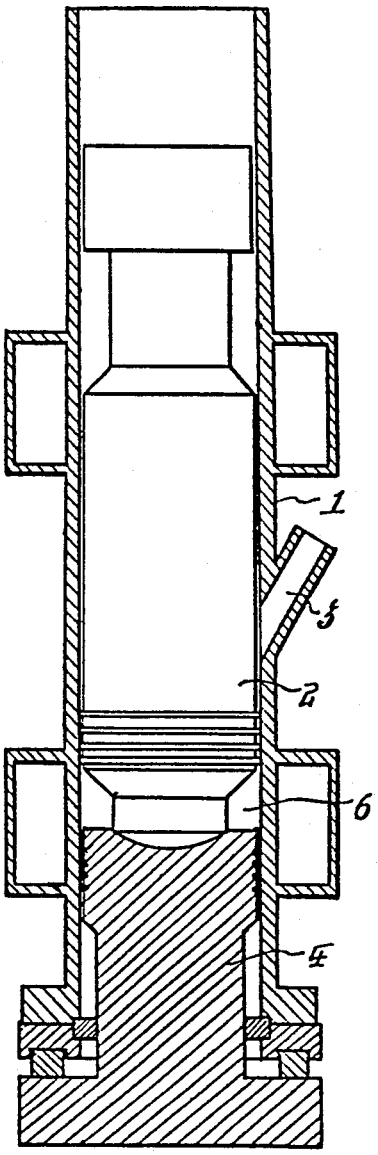
Fig. 1 PRIOR ART
FIG. 1 is a longitudinal cross-section view of an internal combustion type pile driver in the prior art.

Before entering more detailed description of the present invention, a construction and an operation of an internal combustion type pile driver in the prior art will be described with reference to FIG. 1.

In the known internal combustion type pile driver illustrated in FIG. 1, in the course lowering of a ram 2 that is slidably fitted within a cylinder 1, when the lower end of the outer circumference of the ram 2 is lowered below an air intake/exhaust port 3 fixedly provided on the side wall of the cylinder 1, the air confined within the cylinder 1 is compressed.

As a result of the collision of the further lowering ram 2 against an anvil 4 fitted into the bottom end of the cylinder 1, the anvil 4 is lowered and it drives a pile (not shown) and causes the pile to penetrate into the ground.

On the other hand, in response to a shock of the collision between the ram 2 and the anvil 4, a fuel-air mixture gas held at a high-temperature and high-pressure condition within a combustion chamber 6 delimited by the cylinder 1, ram 2 and anvil 4 is explosively burned, and the ram 2 raises by the pressure of this combustion gas.

When the lower end of the outer circumference of the ram 2 rises above the air intake/exhaust port 3, the combustion gas is exhausted into the atmosphere, and as the ram 2 rises further due to its inertia, the pressure within the cylinder 1 becomes lower than the atmospheric pressure, so that fresh air flows into the cylinder 1 through the air intake/exhaust port 3. Eventually when the ram 2 reaches a predetermined maximum height where the inertia motion of the ram 2 disappears, the ram 2 again begins to lower due to gravity, and subsequently the above-mentioned operation cycle is repeated.

The pile driving power of an internal combustion type pile driver is determined mainly by the height of rise of the ram 2. In the internal combustion type pile drivers of the prior art, there were fluctuations in the height of rise of the ram due to machining errors during manufacture, and it was difficult to correct these fluctuations. Furthermore, even if the height of rise of the ram had a proper value when the pile driver was new, when the wear of the cylinder 1, ram 2 and anvil 4 became noticeable as the pile driver was used for a long time, the amount of leakage of air and combustion gas was increased, so that the gas pressure was lowered and the height of rise of the ram became insufficient, resulting in lowering of the pile driving power. Therefore, there was a demand for improvements in the known internal combustion type pile driver so as to eliminate the aforementioned disadvantages.

Figure 2A:
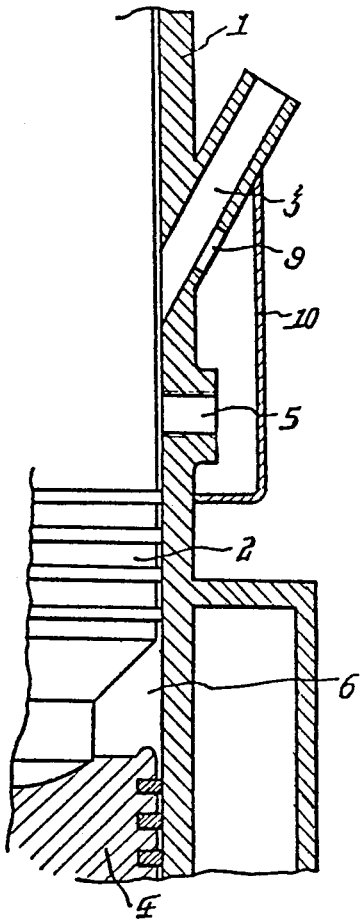
FIG. 2*a* is a longitudinal cross-section view showing an improved structure of an internal combustion type pile driver according to the present invention.
Figure 2B:
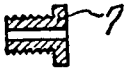
FIG. 2*b* is a longitudinal cross-section view of a choke plug to be selectively fitted in a choke opening in the structure shown in FIG. 2*a*.
Figure 2C:
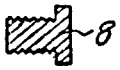
FIG. 2*c* is a longitudinal cross-section view of a blind plug to be selectively fitted in a choke opening in the structure shown in FIG. 2*a*.

Now the present invention will be described in more detail in connection with one preferred embodiment illustrated in FIGS. 2*a*, 2*b* and 2*c* of the drawings. Referring to these figures, the internal combustion type pile driver according to the present invention has a cylinder 1, a ram 2 slidably fitted within the cylinder 2, an anvil 4 fitted into the bottom end of said cylinder 1, an air intake/exhaust port 3 fixedly provided on the side wall of the cylinder 1, a choke opening 5 for by-passing an exhaust path of combustion gas, a by-pass opening 9 provided in the wall of the air intake/exhaust port 3, a cover plate 10 which covers a part of the outer surface of the cylinder 1 and the air intake/exhaust port 3 including the choke opening 5 and the by-pass opening 9 to delimit a gas passageway for communicating the outer end of the choke opening 5 with the air intake/exhaust port 3, and choke plugs 7 having small bores of different diameters drilled therethrough and a blind plug 8 having no bore, one of which may be selectively fitted into the choke opening 5. In the illustrated embodiment, the choke plug 7 and the blind plug 8 are threaded on their outer circumference and are adapted to be screwed into the choke opening 5 which is complementarily threaded on its inner circumference. Here it is to be noted that the choke opening 5 for by-passing the exhaust path of combustion gas is provided in the side wall of the cylinder 1 between the air intake/exhaust port 3 and the combustion chamber 6 delimited by the cylinder 1, ram 2 and anvil 4 when the ram is at its lowermost position as shown in FIG. 2*a*.

In the course of lowering of the ram 2, when the lower end of the outer circumference of the ram 2 is lowered below the air intake/exhaust port 3, the air confined within the cylinder 1 is compressed. Subsequently, as a result of further lowering ram 2 against the anvil 4, the anvil 4 is lowered and drives a pile (not shown) into the ground.

On the other hand, in response to a shock of the collision between the ram 2 and the anvil 4, a fuel-gas mixture held in a high-temperature high-pressure condition within the combustion chamber 6 will explosively burn, and the ram 2 raises due to the pressure of this combustion gas.

When the lower end of the outer circumference of the ram 2 rises above the choke opening 5 for adjustment of gas pressure, combustion gas within the cylinder 1 discharges at a controlled rate from the choke opening 5 through the gas passageway delimited by the cover plate 10, the by-pass opening 9 and the air intake/exhaust port 3 into the atmosphere, and thereby the gas pressure within the cylinder 1 can be adjusted properly. The ram 2 is accelerated to rise by this properly adjusted gas pressure, and when the lower end of the outer circumference of the ram 2 rises above the air intake/exhaust port 3, the combustion gas exhausts into the atmosphere.

As the ram 2 rises further due to its inertia, the pressure within the cylinder 1 becomes lower than the atmospheric pressure, and fresh air flows into the cylinder 1 through the air intake/exhaust port 3. Eventually when the ram reaches a predetermined maximum height where the inertia motion of the ram 2 disappears, the ram 2 again begins to lower due to a gravity, and subsequently the above-mentioned operation cycle is repeated.

As mentioned previously, the internal combustion type pile drivers in the prior art had large fluctuations in the height of rise of the ram 2 due to machining errors during manufacture. However, in the case of the internal combustion type pile driver according to the present invention having the above-mentioned construction, by selecting a choke plug 7 having a small bore of the appropriate diameter drilled therethrough out of a set of choke plugs having small bores of different diameters drilled therethrough, or a blind plug 8 having no bore, and fitting the same into the choke opening 5, the fluctuations in the height of rise of the ram 2 can be eliminated, and thus internal combustion type pile drivers having a predetermined driving power can be manufactured uniformly. Also, when wear of the cylinder 1, ram 2 and anvil 4 has become noticeable after a long period of use, and the rate of leakage of air and combustion gas is increased (which results in a lowering of the gas pressure and leads to an insufficient height of rise of the ram 2,) by replacing the choke plug 7 with another choke plug 7 having a smaller bore diameter or even with a blind plug 8 having no bore, the rate of discharge of the combustion gas through the choke opening 5 for adjustment of a gas pressure, is reduced or made zero. Thus, by raising the combustion gas pressure within the cylinder 1, the original height of rise of the ram 2 can be achieved again.

Comparing the effects and advantages of the internal combustion type pile drivers according to the present invention with those of the similar pile drivers in the prior art, in contrast to the fact that the air intake/exhaust port in the internal combustion type pile drivers in the prior art is inadjustable so that large fluctuations in the ram stroke arise due to machining errors or wear of the respective parts and because the fluctuations could be hardly corrected due to lack of ram stroke correcting means, according to the present invention adjustment of the air intake/exhaust port is possible by providing an adjustable by-pass passageway and to adjustment of the ram stroke is possible, and the quality of the manufactured pile drivers is stabilized and the used pile drivers which have insufficient ram strokes can be repaired so as to recover their original ram strokes.

Since many changes can be made in the above construction and many apparently widely different embodiments of this invention can be made without departing from the scope thereof, it is intended that all matter contained in the above description or shown in the accompanying drawings shall be interpreted as illustrative and not in a limiting sense.

What is claimed is:

1. An internal combustion type pile driver comprising:

a cylinder having a cylinder wall;

an anvil fitted into the bottom of said cylinder;

a piston in said cylinder above said anvil;

an air intake/exhaust port fixedly provided through said wall thereof above said anvil and communicated with the atmosphere, said cylinder having a choke opening through said wall thereof between said air intake/exhaust port and said anvil and communicated with the atmosphere; and plug means fitted into said choke opening for regulating the pressure between the inside said cylinder and the atmosphere through said choke openings, said plug means being comprised of at least one first plug fittable into said choke openings, said first plug having a bore therethrough and a second plug fittable into said choke opening, said second plug being solid.

2. A pile driver as claimed in claim 1, wherein a plurality of first plugs are provided, each of said first plugs having a bore therethrough differing in diameter from the bores in the other first plugs.

3. A pile driver as claimed in claim 1, further comprising an air passage way connecting said choke opening on the outside of said cylinder and said air intake/exhaust port.

4. A pile driver as claimed in claim 3, wherein said air intake/exhaust port has a by-pass opening thereinto; and said gas passageway is a coverplate spaced from and surrounding the outside of said cylinder and covering both said choke opening and said by-pass opening, whereby said choke opening is communicated with said by-pass opening through the space between said coverplate and the outside of said cylinder.

* * * * *